United States Patent [19]

Irie et al.

[11] Patent Number: 4,581,107

[45] Date of Patent: Apr. 8, 1986

[54] PROCESS FOR PREPARING IMPROVED ZN-NI-ALLOY ELECTROPLATED STEEL SHEETS

[75] Inventors: Taisuke Irié; Yoshitaka Nakagawa; Masayoshi Tatano, all of Osaka; Koichi Watanabe, Hyogo; Eiji Watanabe, Osaka, all of Japan

[73] Assignee: Nisshin Steel Company, Ltd., Tokyo, Japan

[21] Appl. No.: 644,039

[22] Filed: Aug. 24, 1984

[30] Foreign Application Priority Data

Sep. 2, 1983 [JP] Japan ..... 58-161596

[51] Int. Cl.[4] ..... C25D 5/48

[52] U.S. Cl. ..... 204/27; 204/35.1; 204/37.1; 204/44.2

[58] Field of Search ..... 204/35.1, 37.1, 44.2, 204/27

[56] References Cited

U.S. PATENT DOCUMENTS 4,313,802 2/1982 Shibuya et al. ..... 204/28
4,388,160 6/1983 Rynne ..... 204/38.1

FOREIGN PATENT DOCUMENTS 56-293 1/1981 Japan ..... 204/44.2

OTHER PUBLICATIONS

Walter W. E. Hübner, *The Practical Anodizing of Aluminum,* MacDonald & Evans, London, 1960, pp. 88–90.

*Primary Examiner*—John F. Niebling
*Assistant Examiner*—William T. Leader
*Attorney, Agent, or Firm*—Webb, Burden, Robinson & Webb

[57] ABSTRACT

Improved Zn-Ni-alloy-electroplated steel sheet can be prepared by electroplating steel sheet with an acid electroplating bath containing Zn ions, Ni ions and a small amount of titanium ions, preferably after pre-electroplating with an electroplating bath containing Zn ions and a larger amount of Ni ions and heating the plating sheet in the presence of water.

14 Claims, No Drawings

PROCESS FOR PREPARING IMPROVED ZN-NI-ALLOY ELECTROPLATED STEEL SHEETS

TECHNICAL FIELD OF THE INVENTION

This invention relates to preparation of improved Zn-Ni-alloy electroplated steel sheet. In other words, this invention relates to a method of after-treatment of steel sheet electroplated with Zn-Ni-alloy containing titanium compounds, by which the corrosion resistance of the plated layer can be enhanced.

BACKGROUND OF THE INVENTION

Zinc-electroplated steel sheet has excellent corrosion resistance and therefore is used in various fields. The corrosion resistance of the plated layer thereof is usually enhanced by forming a chromate film on the surface thereof. However, the chromate film is extremely thin and lacks uniformity in thickness. It is easily scratched off and its corrosion resistance enhancement effect is limited.

Therefore in recent years, attempts have been made to improve the corrosion resistance of the plated layer by incorporating therein an element or elements in addition to zinc. Zn-Ni-alloy electroplating of steel sheets is a typical example. However, the conventional Zn-Ni-alloy-electroplated layer contains 8–16 wt % of expensive Ni, and the steel sheet must be plated as thickly as 20 g/m$^2$ (per side) in coating weight in order to obtain stable corrosion resistance 3–4 times greater than the corrosion resistance of the conventional Zn-electroplated steel sheets. The cost therefor is equivalent to that for providing a conventional Zn-electroplated layer with double thickness. Therefore, known Zn-Ni-alloy-electroplated steel sheets can compete with conventional Zn-electroplated steel sheets in fields where Zn-electroplated steel sheets with coating weight of 40 g/m$^2$ (per side) or more must be used. But the Zn-Ni-alloy-electroplated steel sheet cannot compete with the conventional Zn-electroplated steel sheet in the fields where Zn-electroplated steel sheet plated as thickly as 40 g/m$^2$ (per side) does not have to be used, since the Zn-electroplated steel sheet is less expensive.

We made an extensive study in order to develop a Zn-Ni-alloy electroplated steel sheet which is superior to known Zn-Ni-alloy electroplated steel sheets in corrosion resistance with the same coating weight, and we have found that such a Zn-Ni-alloy electroplated steel sheet can be obtained by causing a slight amount of titanium(in the form of some titanium compounds) to deposit in a finely distributed state in the Zn-Ni-alloy plated layer. As a result of a further detailed study, it was found that it is adequate for the Zn-Ni-alloy-plated layer containing 8–16% by weight Ni to contain titanium in the amount of 0.0005–1% by weight as titanium.

The Zn-Ni-alloy-electroplated steel sheet having such a composition exhibits considerably good corrosion resistance with a single plated layer, and can compete with the inexpensive Zn-electroplated steel sheet in fields where high corrosion resistance is not required.

The titanium-compound-containing Zn-Ni-alloy electroplated steel sheet can be obtained by electroplating steel sheet with an acidic, preferably sulfuric acid acidic, electroplating bath containing 10–40 g/l $ZN^{2+}$, 15–160 g/l $Ni^{2+}$, 0.2–10 g/l $Ti^{4+}$, whereby the $Ni^{2+}/(Zn^{2+}+Ni^{2+})$ ratio is adjusted to be about 0.2–0.8 in the molar concentration. (Japanese Laid-Open Patent Publication No. 104194/83).

However, in the case where electroplated steel sheet is used for automobile body exterior panel, which may be hit by stones kicked up by the tires or by other cars, the plated layer may peel off at the spot where the stone hits. When used in such an application, it is preferred that the steel sheet be first pre-electroplated with a Zn-Ni-alloy, and then be plated with the Zn-Ni-alloy containing titanium compounds of the composition as mentioned above as the principal plated layer. The pre-plated layer should be a Zn-Ni-alloy containing 12–87% by weight Ni and have a thickness of 0.05–1 μm.

When a steel sheet is plated with two layers, that is, when the steel sheet is pre-plated with a nickel-rich Zn-Ni-alloy layer, the steel sheet is first pre-plated with a plating bath containing zinc ions $Zn^{2+}$ and nickel ions $Ni^{2+}$ whereby the $Ni^{2+}/(Zn^{2+}+Ni^{2+})$ratio is adjusted to be 0.72–0.86 in the molar concentration (0.70–0.85 in the weight ratio) and then is plated with the same plating bath as described above (Japanese Laid-Open Patent Publication No. 85889/84).

When a steel sheet is electroplated with the electroplating bath containing zinc ions, nickel ions and titanium ions as described above, however, the amount of the deposited titanium compounds varies in accordance with the time course change of the bath and fluctuation in the plating conditions, and the corrosion resistance of the plated sheet may vary. It was also confirmed that the deposition of the titanium compounds are stabilized by addition of a small amount of each of one or more of aluminum ions, magnesium ions, ferric ions, indium ions and antimony ions to the bath containing zinc, nickel and titanium. The reason why the deposition of the titanium compound is stabilized by addition of aluminum ions, etc. is not yet fully understood. But it was confirmed that the thus plated layer contains a slight amount of aluminum, iron, chromium, indium or antimony when aluminum ions, ferric ions, chromium ions, indium ions or antimony ions are contained in the plating bath.

There has been known no measure for after-treatment of the thus plated layer practised other than the chemical conversion, such as chromating, when a highly corrosion-resistant plated layer is formed by improvement of the composition of the plated layer. We made a study in search of an after-treatment method which can improve the corrosion resistance of the Zn-Ni-alloy-electroplated layer containing titanium compounds and found that the corrosion resistance of the plated layer is enhanced by heating the plated steel sheet in the presence of water.

DISCLOSURE OF THE INVENTION

This invention provides a process for preparing improved Zn-Ni-alloy-electroplated steel sheet comprising electroplating a steel sheet with an acidic bath containing 10–40 g/l $Zn^{2+}$, and 15–160 g/l $Ni^{2+}$, 0.2–10 g/l $Ti^{4+}$, which may further contain less than 2 g/l of at least one of $Al^{3+}$, $Mg^{2+}$, $Fe^{3+}$, $Cr^{3+}$, $In^{3+}$ and $Sb^{3+}$ whereby the $Ni^{2+}/(Zn^{2+}+Ni^{2+})$ratio is adjusted to be about 0.2–0.8 in the molar concentration; and heating the resulting plated sheet in the presence of water.

This invention further provides a process for preparing improved Zn-Ni-alloy-electroplated steel sheet comprising pre-electroplating a steel sheet with a bath containing $Zn^{2+}$ and $Ni^{2+}$, whereby the $Ni^{2+}/(Zn^{2+}$-

$+Ni^{2+}$)ratio is adjusted to be about 0.72–0.86 in the molar concentration ratio; electroplating the resulting pre-plated steel sheet with an acidic bath containing 10–40 g/l $Zn^{2+}$, 15–160 g/l $Ni^{2+}$, 0.2–10 g/l $Ti^{4+}$, which may further contain less than 2 g/l of at least one of $Al^{3+}$, $Mg^{2+}$, $Fe^{3+}$, $Cr^{3+}$, $In^{3+}$ and $Sb^{3+}$, whereby the $Ni^{2+}/(Zn^{2+}+Ni^{2+})$ratio is adjusted to be about 0.2–0.8 in the molar concentration; and heating the plated steel sheets in the presence of water.

The process for forming the single layer Ti-containing Zn-Ni-electroplated layer is described in detail in Japanese Laid-Open Patent Publication No. 104194/83.

The process for pre-plating steel sheets is described in detail in Japanese Laid-Open Patent Publication No. 85889/84. This process comprises electroplating a steel sheet in an acidic bath containing 7–38 g/l Zn and 41–88 g/l Ni whereby the concentration ratio $Zn^{2+}/(Zn^{2+}+Ni^{2+})$ is 0.70–0.85 at 55°–80° C. with electric current density of 2–20 A/dm$^2$ so as to form a pre-plated layer containing 12–87% by weight Ni.

In the preferred embodiment, the pre-plating bath contains 11–34 g/l Zn and 62–79 g/l Ni, and the principal plating bath contains 12–25 g/l Zn, 20–60 g/l Ni and 1–8 g/l Ti.

In the more preferred embodiment, the pre-plating bath contains 15–30 g/l Zn and 62–70 g/l Ni, and the principal plating bath contains 13–21 g/l Zn, 30–50 g/l Ni and 3–7 g/l Ti.

The acidifying agent may be hydrochloric acid and/or sulfuric acid for the pre-plating bath and principal plating bath. The bath temperature is preferably 55°–80° C. for the pre-plating and preferably 50°–70° C. for the principal plating. The current density is preferably 2–20 A/dm$^2$ for the pre-plating and preferably 10–40 A/dm$^2$ for the principal plating.

Metal ions can be added in the plating bath in the form of a suitable salt of the metal. Chlorides, sulfates, nitrates and acetates can advantageously be used. However, titanium is added to the bath preferably in the form of tartarate, oxalate, sodium titanium fluoride, or potassium titanium fluoride.

Aluminum ions, magnesium ions, ferric ions, chromium ions, indium ions and antimony ions are added to the bath preferably in a concentration of 0.05–1.0 g/l.

The enhancement of the corrosion resistance by heating in the presence of water is specific to the Zn-Ni-alloy-plated layer containing titanium compounds and this effect is not observed in plated layers containing no titanium.

Concerning the reason for the enhancement of corrosion resistance of the plated layer by heating in the presence of water, the following fact was found by a detailed investigation of the plated layer before and after the treatment. The titanium compounds deposited in the plated layer are low degree hydrolysates of titanium complexes formed in electroplating, which are further hydrolyzed to stable compounds by heating in the presence of water. The above-mentioned low degree hydrolysates deposit concentrated at the outermost layer at the time of plating. This hydrolysates are converted to stable compounds by further hydrolysis, which form a highly corrosion-resistant film on the surface of the plated layer, and the film contributes to enhancement of the corrosion resistance.

The heating in the presence of water is to further hydrolyze the low degree hydrolysate. Therefore, it is preferably carried out in the presence of abundant water, that is, soaking in hot water, heating in steam, etc. are preferred. Especially, soaking in hot water is most preferred from the viewpoint of facility in operation and the construction of the equipment. It is also preferable to employ higher temperatures and/or to use alkaline water in order to accelerate the hydrolysis. When a plated steel sheet is soaked in water of 60° C., at least 40 seconds are required. But in water of 80° C., the soaking time is shortened to 10 seconds or less, and in boiling water to 5 seconds or less. In the same way, the soaking time is shortened by one half when hot water of pH of 9.0 is used. However, the pH of the hot water should preferably be not more than 10, since water of a too high pH value tends to dissolve the plated layer. When alkaline water is used, hydrolysis can be carried out at lower temperatures, that is, hydrolysis of the low degree hydrolysates of the titanium compounds is satisfactorily effected at 40° C.

DESCRIPTION OF EMBODIMENTS OF THE INVENTION

Cold-rolled steel sheets 0.8 mm in thickness were degreased, pickled by the conventional methods and alloy-electroplated with the plating baths and the plating conditions indicated in Table 1. The resulting plated sheets were soaked in hot water under the conditions indicated in Table 2. The chemical compositions of the plated layers were as shown in Table 3. The plated sheets were subjected to the salt spray test as stipulated in JIS (Japanese Industrial Standards) Z2371 and the times until red rust was formed were measured. The results are summarized in Table 4.

As apparent from Table 4, the conventional Zn-Ni-alloy electroplated steel sheets are not improved in corrosion resistance. In contrast, corrosion resistance of titanium-compound-containing Zn-Ni-alloy-electroplated steel sheets is remarkably improved by soaking in hot water in comparison with the samples not soaked. The titanium-compound-containing Zn-Ni-alloy-electroplated steel sheets obtained by using plating baths containing the above-mentioned titanium-compound-stabilizing ions such as aluminum ions, magnesium ions, etc. were high in the amount of deposited titanium compounds. The corrosion resistance of such electroplated sheets was improved by hot water soaking by a factor of around 2. Owing to this treatment, the coating weight could be reduced from 20 g/m$^2$ of the conventional Zn-Ni-alloy electroplated steel sheet to 15 g/m$^2$ (per side) with improved corrosion resistance. Therefore, the plating cost can be substantially reduced.

As has been described above, the corrosion resistance of titanium-compound-containing Zn-Ni alloy electroplated steel sheet is remarkably improved by heating in the presence of water in comparison with that of the conventional Zn-Ni alloy electroplated steel sheet. Therefore, a thinner-plated layer suffices to achieve the same level of corrosion resistance. Thus the plating cost can be reduced, making it possible for the electroplated steel sheet in accordance with this invention to compete with the conventional Zn-electroplated steel sheet in price in applications in which the former has not been to compete up to now.

TABLE 1

| Plating bath | Composition of pre-plating bath (g/l) $Zn^{2+}$ | $Ni^{2+}$ | Composition of principal plating bath (g/l) $Zn^{2+}$ | $Ni^{2+}$ | $Ti^{4+}$ | $Al^{3+}$ | $Mg^{2+}$ | $Fe^{3+}$ | $Cr^{3+}$ | $In^{3+}$ | $Sb^{3+}$ | Conditions of pre-plating PH* | Temp. (°C.) | Current density (A/dm²) | Conditions of principal plating PH* | Temp. (°C.) | Current density (A/dm²) |
|---|---|---|---|---|---|---|---|---|---|---|---|---|---|---|---|---|---|
| A | — | — | 30 | 60 | 4 | — | — | — | — | — | — | — | — | — | 2.0 | 60 | 20 |
| B | — | — | 30 | 60 | 4 | 0.1 | — | — | — | — | — | — | — | — | 2.0 | 60 | 20 |
| C | — | — | 30 | 60 | 4 | 0.05 | 5 | — | — | — | — | — | — | — | 2.0 | 60 | 40 |
| D | — | — | 30 | 60 | 4 | — | — | 1.0 | 0.2 | — | — | — | — | — | 2.0 | 60 | 40 |
| E | — | — | 30 | 60 | 4 | — | — | — | — | 1.0 | — | — | — | — | 2.0 | 60 | 20 |
| F | — | — | 30 | 60 | 4 | — | — | — | — | — | 1.0 | — | — | — | 2.0 | 60 | 20 |
| G | 20 | 60 | 30 | 60 | 4 | 0.1 | — | — | — | — | — | 2.0 | 65 | 10 | 2.0 | 60 | 20 |
| Comparative bath | — | — | 30 | 60 | — | — | — | — | — | — | — | — | — | — | 2.0 | 60 | 20 |

*Sulfuric acid.

TABLE 2

| Hot water soaking | Treatment conditions Alkalinity | Temp. (°C.) | Time (sec.) |
|---|---|---|---|
| 1 | Neutral | 98 | 5 |
| 2 | Neutral | 70 | 30 |
| 3 | pH 9.5 | 80 | 7 |
| 4 | pH 9.5 | 50 | 30 |
| 5 | pH 8.0 | 90 | 10 |
| 6 | pH 8.0 | 60 | 25 |

TABLE 3

| Plated layer | Pre-plated layer Ni content (wt %) | Coating weight (g/m² per side) | Composition of principal plated layer (wt %) Ni | Ti | Al | Fe | Cr | In | Sb | Zn | Total weight of plated layers g/m² per side |
|---|---|---|---|---|---|---|---|---|---|---|---|
| A | — | — | 10 | 0.03 | — | — | — | — | — | balance | 15 |
| B | — | — | 12 | 0.06 | 0.002 | — | — | — | — | " | 15 |
| C | — | — | 13 | 0.05 | 0.001 | — | — | — | — | " | 15 |
| D | — | — | 12 | 0.06 | — | 0.2 | 0.02 | — | — | " | 15 |
| E | — | — | 11 | 0.05 | — | — | — | 0.1 | — | " | 15 |
| F | — | — | 11 | 0.05 | — | — | — | — | 0.05 | " | 15 |
| G | 24 | 1.8 | 12 | 0.07 | 0.002 | — | — | — | — | " | 15 |
| Comparative bath 1 | — | — | 12 | — | — | — | — | — | — | " | 15 |
| Comparative bath 2 | — | — | 12 | — | — | — | — | — | — | " | 20 |

TABLE 4

| Hot water soaking | Plated layer | Time to formation of red rust (hr.) |
|---|---|---|
| 1 | A | 192 |
| | B | 276 |
| | C | 288 |
| | D | 264 |
| | E | 264 |
| | F | 264 |
| | G | 312 |
| | Comparative 1 | 120 |
| | Comparative 2 | 240 |
| 2 | A | 192 |
| | B | 288 |
| | C | 288 |
| | Comparative 1 | 120 |
| 3 | D | 276 |
| | E | 264 |
| | F | 264 |
| | Comparative 1 | 120 |
| 4 | A | 192 |
| | B | 276 |
| | C | 276 |
| | Comparative 1 | 120 |
| 5 | D | 204 |

TABLE 4-continued

| Hot water soaking | Plated layer | Time to formation of red rust (hr.) |
|---|---|---|
| | E | 264 |
| | F | 276 |
| | Comparative 1 | 120 |
| 6 | A | 192 |
| | B | 300 |
| | C | 288 |
| | Comparative 1 | 120 |
| Without hot water soaking | | |
| 1 | A | 144 |
| 2 | B | 168 |
| 3 | C | 168 |
| 4 | Comparative 1 | 120 |

We claim:

1. A process for preparing improved Zn-Ni-alloy-electroplated steel sheet comprising electroplating a steel sheet with an acidic plating bath containing 10–40 g/l $Zn^{2+}$, 15–160 g/l $Ni^{2+}$, and 0.2–10 g/l $Ti^{4+}$, wherein the $Ni^{2+}/(Zn^{2+}+Ni^{2+})$ratio is adjusted to be about 0.2–0.8 in the molar concentration; and heating the resulting plated sheet in the presence of abundant water.

2. The process for preparing improved Zn-Ni-alloy-electroplated steel sheet as claimed in claim 1, wherein the plated steel sheet is heated in hot water.

3. The process for preparing improved Zn-Ni-alloy-electroplated steel sheet as claimed in claim 2, wherein the plated steel sheet is heated in hot alkaline water of pH of up to 10.

4. The process for preparing improved Zn-Ni-alloy-electroplated steel sheet as claimed in claim 1, wherein the plated steel sheet is heated in steam.

5. The process for preparing improved Zn-Ni-alloy-electroplated steel sheet as claimed in claim 1, wherein the plating bath contains 12–25 g/l Zn, 20–60 g/l Ni and 1–8 g/l Ti.

6. The process for preparing improved Zn-Ni-alloy-electroplated steel sheet as claimed in claim 5, wherein the plating bath contains 13–21 g/l Zn, 30–50 g/l Ni and 3–7 g/l Ti.

7. The process for preparing improved Zn-Ni-alloy-electroplated steel sheet as claimed in claim 1, wherein the plating bath contains 0.05–1.0 g/l of at least one of $Al^{3+}$, $Mg^{2+}$, $Fe^{3+}$, $Cr^{3+}$, $In^{3+}$ and $Sb^{3+}$.

8. A process for preparing improved Zn-Ni-alloy-electroplated steel sheet comprising pre-electroplating a steel sheet with a pre-plating bath containing $Zn^{2+}$ and $Ni^{2+}$, wherein the $Ni^{2+}/(Zn^{2+}+Ni^{2+})$ ratio is adjusted to be about 0.72–0.86 in the molar concentration ratio; electroplating the resulting pre-plated steel sheet with an acidic principal plating containing 10–40 g/l $Zn^{2+}$, 15–160 g/l $Ni^{2+}$, and 0.2–10 g/l $Ti^{4+}$, wherein the $Ni^{2+}/(Zn^{2+}+Ni^{2+})$ ratio is adjusted to be about 0.2–0.8 in the molar concentration; and heating the plated steel sheets in the presence of abundant water.

9. The process for preparing improved Zn-Ni-alloy-electroplated steel sheet as claimed in claim 8, wherein the plated steel sheet is heated in hot water.

10. The process for preparing improved Zn-Ni-alloy-electroplated steel sheet as claimed in claim 9, wherein the plated steel sheets are heated in hot alkaline water of pH of up to 10.

11. The process for preparing improved Zn-Ni-alloy-electroplated steel sheets as claimed in claim 8, wherein the plated steel sheets are heated in steam.

12. The process for preparing improved Zn-Ni-alloy-electroplated steel sheets as claimed in claim 8, wherein the pre-plating bath contains 11–34 g/l Zn and 62–79 g/l Ni, and the plating bath contains 12–25 g/l Zn, 20–60 g/l Ni and 1–8 g/l Ti.

13. The process for preparing improved Zn-Ni-alloy-electroplated steel sheets as claimed in claim 12, wherein the pre-plating bath contains 15–30 g/l Zn and 62–70 g/l Ni, and the principal plating bath contains 13–21 g/l Zn, 30–50 g/l Ni and 3–7 g/l Ti.

14. The process for preparing improved Zn-Ni-alloy electroplated steel sheets as claimed in claim 8, wherein the principal plating bath contains 0.05–1.0 g/l of at least one of $Al^{3+}$, $Mg^{2+}$, $Fe^{3+}$, $Cr^{3+}$, $In^{3+}$ and $Sb^{3+}$.

* * * * *